United States Patent [19]

Guntermann et al.

[11] Patent Number: 4,830,611

[45] Date of Patent: May 16, 1989

[54] PROCESS FOR WELDING A RAILWAY RAIL, ALUMINOTHERMIC HEATING BLOCKS FOR USE IN THE PROCESS, AND METHOD OF MAKING SAID ALUMINOTHERMIC HEATING BLOCKS

[75] Inventors: Johannes Guntermann, Essen, Fed. Rep. of Germany; Donald R. Macrae, Transvaal, South Africa

[73] Assignee: Elektro-Thermit GmbH, Essen, Fed. Rep. of Germany

[21] Appl. No.: 64,205

[22] Filed: Jun. 18, 1987

[51] Int. Cl.[4] ..... F27B 15/00

[52] U.S. Cl. ..... 432/225; 432/226; 432/197

[58] Field of Search ..... 432/225, 226, 197

[56] References Cited

U.S. PATENT DOCUMENTS

| | | | |
|---|---|---|---|
| 2,809,265 | 10/1957 | Jackson | 432/225 |
| 3,833,338 | 9/1974 | Badrock | 432/225 |
| 4,137,966 | 2/1979 | Ulrich et al. | 432/225 |
| 4,580,972 | 4/1986 | Hsiung | 432/225 |
| 4,673,122 | 6/1987 | Dubey | 432/225 |

*Primary Examiner*—Henry C. Yuen

*Attorney, Agent, or Firm*—Toren, McGeady & Associates

[57] ABSTRACT

Aluminothermic heating blocks for use in heating metal objects, such as rails, and methods for their manufacture are disclosed. The blocks are made by setting a mass of particulate aluminum, iron oxide, heat absorbing material, alkali metal silicate binder and water.

6 Claims, 1 Drawing Sheet

PROCESS FOR WELDING A RAILWAY RAIL, ALUMINOTHERMIC HEATING BLOCKS FOR USE IN THE PROCESS, AND METHOD OF MAKING SAID ALUMINOTHERMIC HEATING BLOCKS

BACKGROUND OF THE INVENTION

This invention relates to a method of making an aluminothermic heating block for use in heating a rail, to an aluminothermic heating block made by the method, and to an aluminothermic heating jacket including the aluminothermic heating block. The invention relates also to a process for heating a rail having a head supported by a web above a foot flange.

SUMMARY OF THE INVENTION

According to one aspect of the invention, there is provided a method of making an aluminothermic heating block for use in heating a rail having a head supported by a web above a foot flange, which method comprises the steps of:

forming a moldable settable material comprising a particulate aluminothermic mixture, a heat absorbing material, an alkali metal silicate binder, and water;

shaping said material into a block having contact surfaces respectively for abutting the foot flange, web and head of a rail; and causing the block to set by subjecting it to an elevated temperature in an atmosphere which contains $CO_2$.

The aluminothermic mixture may comprise aluminium, eg flake aluminium and may have a particle size of less than 1 mm, preferably from 0.2–0.6 mm. The aluminothermic mixture may also comprise iron oxide, which may be in the form of scale, ie a mixture of $Fe_2O_3$ and FeO, which has preferably been heated in oxygen so that the proportion of FeO therein is 5–30% by mass, preferably 5–20%. The particle size of the iron oxide may be 0.1–2 mm, smaller particles, ie those less than 0.2 mm in size, acting in use to speed up the aluminothermic reaction. The moldable settable material may include sand as the heat absorbing material, eg silica sand or quartz sand, and this sand may have a particle size of up to 3 mm, preferably 0.1–1.0 mm.

The alkali metal silicate binder of the moldable settable material may be sodium silicate, and the aluminothermic mixture optionally contains one or more boosters, such as alkali metal nitrates (eg $NaNO_3$ or $KNO_3$), superperoxides (such as $BaO_2$), or the like. It is however expected that, with a suitable selection of iron oxide with a small enough particle size, boosters will typically not be necessary.

Forming the moldable settable material may be by mixing with water constituents having the following composition on a dry basis by mass:

| Constituent | Parts by mass |
|---|---|
| Aluminium | 25–30 |
| Iron Oxide | 27–31 |
| Quartz Sand (heat absorbing material) | 32–38 |
| Sodium Silicate | 2,3–3,4 |

When the block comprises aluminium, iron oxide, quartz sand and sodium silicate as described above, the moldable settable material may be formed by mixing together the aluminium, iron oxide and quartz sand, together with an aqueous solution of the sodium silicate and water. The sodium silicate solution may have a concentration of about 38–48% by mass, preferably 42–46%, eg a solution with a specific gravity of 1.5 g/cm$^3$, corresponding to 48.5° Bé. In this case the moldable settable material may have the following composition:

| Constituent | % by mass |
|---|---|
| Aluminium | 25–30 |
| Quartz Sand | 32–38 |
| Iron Oxide | 27–31 |
| Sodium Silicate Solution | 6–7 |
| Water | 2,5–3 |

Shaping the material into a block having contact surfaces respectively for abutting the foot flange, web and head of a rail may include the steps of moulding the material into the said shape, the moulded block having an indentation in its surface for abutting the web of a rail, for receiving an insert of heat insulating material.

Moulding the material into the said shape may be by ramming it into a pattern. The ramming may take place by core-shooting, or may be effected by hand.

The method may include the step of inserting a mouldable heat-settable refractory heat insulating mix into the indentation to form a heat insulating insert.

The refractory heat insulating mix may comprise sand and exfoliated vermiculite the mix including an alkali metal silicate binder, and being inserted into the indentation by hand. The particle size and size distribution of the sand and the vermiculite may be similar to those of the sand in the moldable settable material of the aluminothermic block. By varying the thickness of the heat insulating insert, the heat output of the block through the insert may be correspondingly varied.

The heat insulating mix which may comprise about 60–80% by mass of the aforesaid quartz sand and about 20–40% by mass vermiculite, may similarly be bound with sodium silicate, the heat insulating mix also containing eg about 6–7% by mass of said 1.5 g/cm$^3$ sodium silicate solution.

The method may include the further steps of causing the block initially to harden and set prior to inserting the heat insulating mix into the indentation, by exposing it to a carbon dioxide atmosphere; and after the heat insulating mix has been inserted into the indentation, causing the block and heat insulating insert further to harden and set by exposure to an elevated temperature falling within the range of about 150° to 250° C. in a carbon dioxide atmosphere for over an hour.

The initial hardening and setting may take place at ambient temperature, and the carbon dioxide may be at a pressure of 0.1 to 0.15 M.Pa.

Preferably, the further hardening and setting may take place at a temperature falling within the range of 150° to 200° C., most preferably 170° to 200° C., eg at 200° C. for 75 minutes.

The method may also include the steps of providing the aluminothermic heating block with at least one insert of a starting aluminothermic mixture which is more easily ignitable than the aluminothermic mixture of the remainer of the aluminothermic block. The insert will, once it has been ignited, serve to ignite said aluminothermic mixture of the remainder of the block. This insert may be on the opposite side of the block from the insert of insulating material. Accordingly the method may include the step of shaping the block with an indentation for the insert of the starting mixture.

The starting mixture may eg be a mix of about 3 parts by mass of said iron oxide with about 1 part by mass of said aluminium, bound together by said sodium silicate solution in similar proportions, i.e. 6–7% by mass, and inserted into the indentation by hand. The starting mixture will be inserted after the initial hardening in carbon dioxide and before heating to an elevated temperature.

The invention extends to an aluminothermic heating block when made by the method described above.

The invention extends yet further to an aluminothermic heating jacket for heating a rail having a head supported by a web above a foot flange, which includes a pair of aluminothermic heating blocks of the kind described for heating opposite sides of the rail, and an aluminothermic slab for covering the top surface of the head of the rail between the blocks, the aluminothermic slab having the same composition as the aluminothermic mixture of the blocks. The aluminothermic slab may also include an insert of a starting aluminothermic mixture.

The invention extends still further to a process for heating a rail having a head supported by a web above a foot flange, by means of an aluminothermic heating block of the kind described which includes the steps of placing the aluminothermic heating block against the side of the rail and seating against it;

igniting the block; and allowing the block to burn until the rail has been heated to a desired temperature.

In the process, preferably two blocks may be placed on opposite sides of the rail and opposed to each other, and ignited simultaneously eg by igniting the starting aluminothermic inserts thereof with $BaO_2$ pyrotechnics, the blocks then being allowed to burn until the rail has been heated to a desired temperature, after which joint welding may take place by pouring molten metal between two heated rail ends, or repair or build-up welding may be carried out on the heated portion of rail.

The blocks may form part of a jacket of the kind described, and the slab of aluminothermic material may be used to enclose and heat the top surface of the head of the rail. The slab of aluminothermic material may instead or in addition be used to re-heat the top surface of the rail after welding to anneal the weld metal and surrounding metal, for a desirable grain structure therein.

The process may include the step of insulating the bottom of the foot flange of the rail by locating a slab of insulating material under said foot flange, during the heating prior to the welding, and during the welding itself.

In its broadest aspect, the invention extends to a method of making a thermic heating element for use in heating a metal object, which method comprises the steps of:

forming a mouldable settable material comprising a particulate thermic mixture, a heat absorbing material, an alkali metal silicate binder and water, the thermic mixture including at least one metal selected from the group comprising aluminium and magnesium, and at least one transition metal oxide;

shaping said material into a block having contact surfaces respectively for abutting the foot flange, web and head of a rail; and causing the block to set by subjecting it to an elevated temperature in an atmosphere which contains $CO_2$.

The transition metal oxide may be an iron oxide or manganese oxide.

BRIEF DESCRIPTION OF THE DRAWINGS

The invention will now be described by way of example, with reference to the accompanying diagrammatic drawings, in which.

DESCRIPTION OF THE EMBODIMENTS

Figure 1:
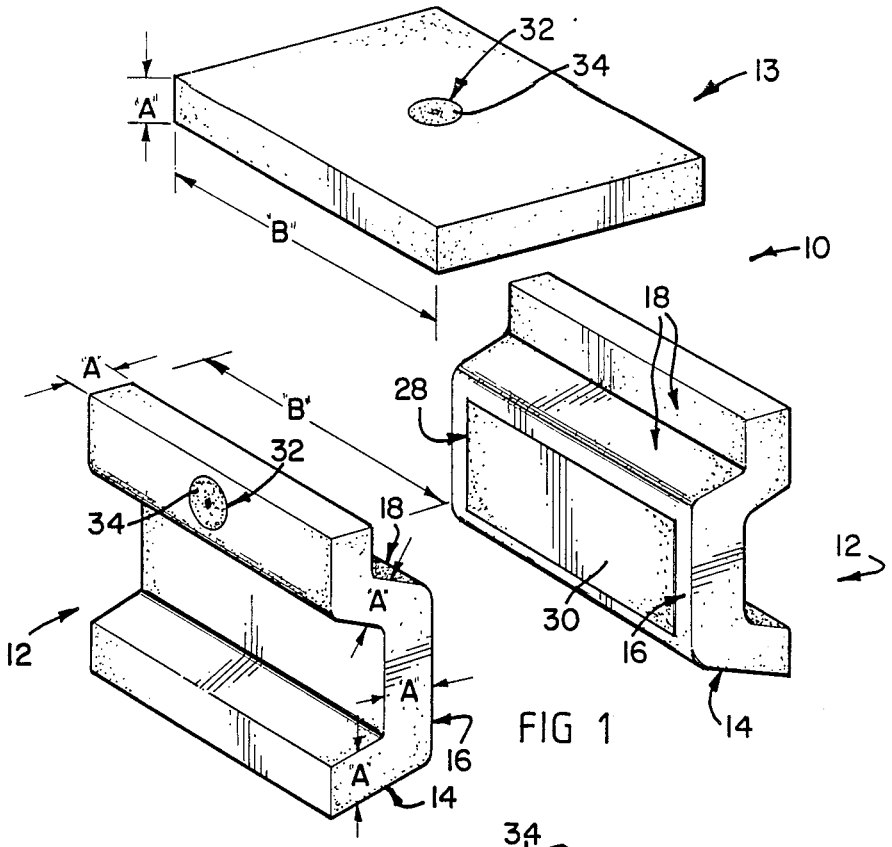
FIG. 1 shows a three dimensional exploded view of a heating jacket including heating blocks according to the invention.
Figure 2:
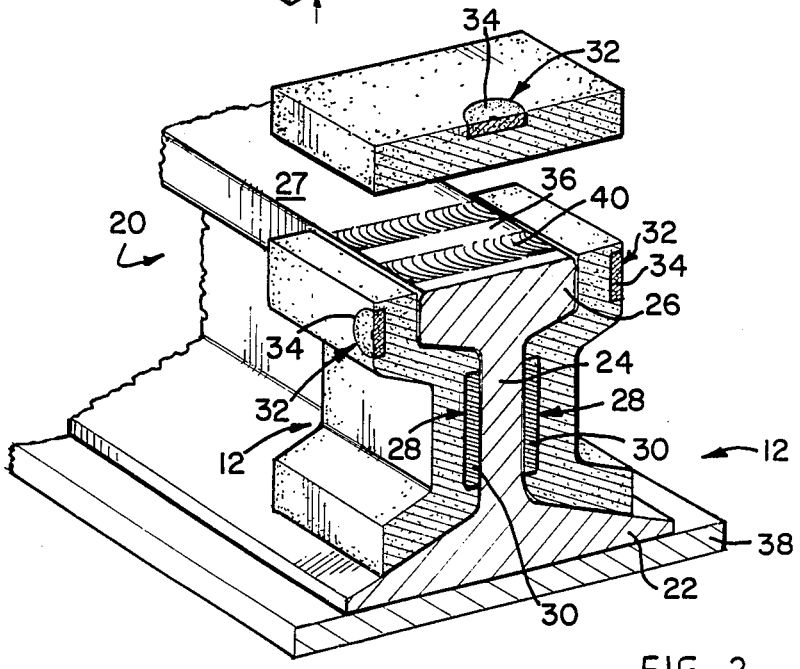
FIG. 2 shows a fragmentary sectional three-dimensional partly exploded view of a heating jacket including heating blocks according to the invention in position on a railway rail.

Referring to the drawings, according to one aspect of the invention an aluminothermic heating jacket 10 made from a moldable settable material includes a pair of aluminothermic blocks 12, shaped according to the method of the invention to have contact surfaces 14, 16 and 18 respectively for abutting a foot flange 22, web 24 and head 26 of a rail 20 (FIG. 2); and an aluminothermic slab 13 for covering the top surface 27 of the rail 20, exposed between the blocks 12.

The blocks 12 are also shaped to have indentations 28 in the surface 16 for abutting the web 24 of the rail 20, the indentations 28 containing inserts 30 of heat insulating material.

The inserts 30 are located on those regions of the blocks 12 of the aluminothermic jacket 10 which in use (FIG. 2) seat against the web 24 of the rail 20, thereby to insulate said web 24 from excess heat generated by the blocks 12.

The blocks 12 and slab 13 are further shaped to have indentations 32 which contain inserts of starting mix 34.

In the method of making an aluminothermic heating block 12, the moldable settable material of the block 12 and slab 13 can have the following dry composition, for example:

| Constituent | Parts by Mass |
|---|---|
| Flake Aluminium | 27 |
| Quartz Sand (heat absorbing material) | 35 |
| Scale (Iron Oxide) | 29 |
| Sodium Silicate (solid) | 3 |

in which the aluminothermic mixture comprises flake aluminium which has a particle size of 0.2–0.6 mm, and scale, which is a mixture of $Fe_2O_3$ and FeO which has been heated in oxygen to have an FeO proportion of about 18% by mass, and a particle size of about 0.1–2 mm; and the quartz sand has a particle size of 0.1–1 mm.

The heat insulating material of the inserts 30 can be a mixture which has the following dry composition, for example:

| Constituents | Parts by Mass |
|---|---|
| Quartz Sand | 67 |
| Exfoliated Vermiculite | 33 |
| Sodium Silicate | 3 |

in which the quartz sand is as described above and the particle size and size distribution of the vermiculite are similar to the particle size and size distribution of the sand.

Finally, the starting mixture of the inserts 34 can have the following dry composition, for example:

| Constituent | Parts by Mass |
|---|---|
| Flake Aluminium | 25 |
| Scale | 75 |
| Sodium Silicate | 3 |

in which the aluminium and scale are as described above.

To make the blocks 12 and the slab 13 of the aluminothermic jacket 10 the mouldable settable material is mixed, shaped by moulding to form the block and slab, and caused to set.

To mix the mouldable settable material the scale, aluminium and sand constituents are mixed in a mixer eg for about 4 minutes, to which mixer is added the sodium silicate (eg in the form of an aqueous solution containing 44% by mass sodium silicate) and about 3% by mass additional water. After further mixing for about 4 minutes the material is ready for moulding.

This mouldable settable material is then mouled by ramming into suitable patterns, either by core-shooting or by hand, whichever is more convenient, to mould the blocks and slabs, the patterns providing for the formation of suitable indentations 32 and 28, in said blocks and slabs, into which indentations the starting mixture of the starting mixture inserts 34 and the insulating material of the inserts 30 are then inserted, to become integral parts of the blocks 12.

The starting mixture similarly has it scale and aluminium mixed in a mixer for say 4 minutes, after which the sodium silicate is added as a solution as described above, followed by mixing for a further 4 minutes. This mixture is inserted by hand after initial hardening of the block 12 in carbon dioxide, into the indentations 32 provided therefor in the blocks 12 and slab 13 to form the inserts 34.

The insulating inserts 30 are formed in a similar fashion by mixing the sand and vermiculite and admixing the silicate therein in the form of the same solution, the mix being inserted into the indentations 28 provided therefor in the blocks 12 by hand, to form said inserts 30, after initial hardening of the blocks 12 in carbon dioxide.

Initial hardening of the blocks 12 is effected by exposing them to carbon dioxide under atmospheric pressure (eg about 0.1 to 0.15 M.Pa) at ambient temperature for about 5 seconds.

Causing the parts of the jacket 10 finally to harden and set is then effected by curing at a temperature of at least 150° C., eg at 200° C. for about 75 minutes.

It should be noted that, in use, the temperature reached during burning of the parts of the jacket is directly related to the thickness of the constituent parts, ie the blocks 12 and slab 13, of the jacket 10. Thus, a jacket whose constituent parts have a thickness of about 20 mm burns to generate a temperature in the rail 20 of about 350° C., while a jacket 10 having a thickness of about 50 mm burns to generate a temperature in the rail 20 of about 700° C. This thickness is indicated by "A" in the drawings.

In accordance with the process of the present invention, the jacket can be used to heat a railway rail 20 during repair or build-up welding of the rail 20, the process including seating against opposite sides of the rail 20, in the region of a weld joint 36, the pair of blocks 12 of the jacket 10. Said blocks 12 are secured in position against the rail 20 by means of side plates and clamps (not shown). The blocks 12 are ignited simultaneously by applying burning $BaO_2$ pyrotechnics to the inserts 34 of starting mixture, and the blocks 12 are allowed to burn until the desired temperature of the rail 20 is reached.

In joint welding of rails the jacket 10 can be used in similar fashion to pre-heat the ends of adjacent rails which are to be welded together by pouring molten weld metal between said ends, to form said weld joint 36.

In practice, in repair welding operations, blocks 12 having a thickness "A" of about 30 mm and a length "B" of about 220 mm, when seated against a typical rail 20, provide a temperature of about 430° C. at the top surface 27 about 6 minutes after ignition. If desired this temperature can be measured, eg by using suitable thermocouples or the like.

In addition, the method includes optionally placing a slab of heat insulating material 38 under the foot flange 22 of the rail 20 in the region of the weld joint 36, prior to heating and welding of the rail 20.

In repair welding, when the desired temperature has been reached, zones of weakness eg those shown at 40 adjacent the weld joint 36 are built-up by repair welding methods while the burning blocks 12, maintain the rail 20 in the region of the zones of weakness 40 at the desired temperature. After repair welding for between about 2 and 5 minutes, the temperature of the top surface 27 drops to about 400° C.

After repair welding, and while the rail is still hot and the blocks 12 are in place, the top surface 27 of the railway line 20 is re-heated by means of the slab 13 which has a thickness "A" of about 35 mm and a length "B" of about 200 mm, to anneal the structure of the weld metal and the surrounding metal, the slab similarly being ignited by $BaO_2$ pyrotechnics applied to its insert 34.

In the typical example under discussion, the aluminothermic slab 13 is placed in position on the built-up repair welded top surface 27 about 12 minutes after ignition of the block portions 12, and ignited. The slab 13 burns to raise the temperature of the top surface 27 from about 400° C. to about 675° C. The slab 13 and blocks 12 are allowed to burn out and the jacket and weld are then allowed to cool off.

The invention has been described with reference to the drawings in the context of a specific application. However, as indicated above the invention extends yet further and more generally to a method of performing welding operations which includes heating an object to be welded in the region which is to be welded to a desired degree by means of one or more aluminothermic blocks according to the invention, welding the object, and re-heating the object to a desired degree by means of aluminothermic blocks according to the invention.

Naturally, as also indicated above, the principle of the invention extends beyond aluminothermic blocks per se, and can also be applied using similar thermic elements containing, instead of or in addition to aluminium, metals such as magnesium which may be used, together with other metal oxides, instead of iron oxide, such as manganese oxide or other transition metal oxides. Because of their cost and availability however, iron oxide and aluminium will generally be preferred. Similarly, although the invention has been described with reference to welding railway rails, the process and/or blocks of the invention can also be used for welding other objects where similar requirements have to be met, eg as regards even heating, the blocks then being appropriately profiled and the heat insulating inserts being appropriately dimensioned and located.

Finally, it should be noted that, instead of inserting the inserts 30, and/or 34 into the block 12 and slab 13 when the block 12 and slab 13 have been initially hardened in carbon dioxide and prior to the final hardening by heating, the inserts 30 and 34 can be separately moulded and hardened by heating. They will then be pressed into the block 12 and slab 13 while the block 12 and slab 13 are in a soft green state in the mould or pattern, prior to initial hardening of the block 12 or slab 13 in carbon dioxide.

What is claimed is:

1. An aluminothermic heating apparatus comprising a heating block having a contour complementary to a portion of the contour of a metal object, such as a rail, to be heated, said block being formed from a mass of a particulate aluminothermic mixture, a heat absorbing material, an alkali metal silicate binder and water, said block being ignitable by pyrotechnical means contactable to said block.

2. An apparatus according to claim 1, and further comprising an aluminothermic heating jacket for heating a rail having a head supported by a web above a foot flange, said jacket including a pair of said aluminothermic heating blocks provided so as to heat opposite sides of the rail, and an aluminothermic slab provided so as to cover the top surface of the head of the rail between the pair of blocks, the aluminothermic slab having the same composition as said aluminothermic blocks.

3. A process for heating a rail having a head supported by a web above a foot flange by an aluminothermic heating block formed from a mass of a particulate aluminothermic mixture, a heat absorbing material, an alkali metal silicate binder and water, comprising the steps of:

placing the aluminothermic heating block against the side of the rail and seating against it;

igniting the block pyrotechnically; and allowing the block to burn until the rail has been heated to a desired temperature.

4. A process according to claim 3, wherein said placing step includes placing two heating blocks on opposite sides of the rail and opposed to each other, and said igniting step including igniting the blocks simultaneously.

5. A process according to claim 4, and further comprising the steps of placing a slab of an aluminothermic material on the top surface of the rail bridging said heating blocks so as to enclose and heat said top surface.

6. A process according to claim 3, further comprising the step of insulating the bottom of the foot flange of the rail by locating a slab of insulating material under said foot flange.

* * * * *

UNITED STATES PATENT AND TRADEMARK OFFICE

CERTIFICATE OF CORRECTION

PATENT NO. : 4,830,611

DATED : May 16, 1989

INVENTOR(S) : Johannes Guntermann

It is certified that error appears in the above-identified patent and that said Letters Patent is hereby corrected as shown below:

[30] Foreign Application Priority Data

June 18, 1986 South Africa.....86/4553

Signed and Sealed this

Sixteenth Day of January, 1990

*Attest:*

JEFFREY M. SAMUELS

*Attesting Officer*

*Acting Commissioner of Patents and Trademarks*